US006124576A

United States Patent [19]

Zapf et al.

[11] Patent Number: 6,124,576

[45] Date of Patent: Sep. 26, 2000

[54] ARRANGEMENT FOR LIMITING THE TEMPERATURE OF A GLASS-CERAMIC COOKING ZONE

[75] Inventors: Martin Zapf; Heiko Friedrich, both of Auerbach, Germany

[73] Assignee: Cherry GmbH, Auerbach, Germany

[21] Appl. No.: 09/336,545

[22] Filed: Jun. 16, 1999

[30] Foreign Application Priority Data

Jun. 24, 1998 [GB] United Kingdom ..... 198 28 052

[51] Int. Cl.[7] ..... H05B 3/02

[52] U.S. Cl. ..... 219/485; 219/464

[58] Field of Search ..... 219/485, 464, 219/458, 460, 463, 465, 466

[56] References Cited

U.S. PATENT DOCUMENTS

| | | | |
|---|---|---|---|
| 4,201,184 | 5/1980 | Scheidler et al. | 126/39 J |
| 4,544,831 | 10/1985 | Bayer | 219/449 |
| 4,808,798 | 2/1989 | Goessler et al. | 219/464 |
| 5,258,736 | 11/1993 | Kristen et al. | 338/22 R |

FOREIGN PATENT DOCUMENTS

| | | |
|---|---|---|
| 0 467 134 | 1/1992 | European Pat. Off. . |
| 7 315 318 | 7/1973 | Germany . |
| 34 40 156 | 5/1985 | Germany . |
| 37 44 372 | 7/1988 | Germany . |
| 37 36 005 | 5/1989 | Germany . |
| 38 37 096 | 5/1989 | Germany . |
| 40 22 846 | 1/1992 | Germany . |
| 43 41 486 | 6/1995 | Germany . |
| 195 04 473 | 8/1996 | Germany . |
| 195 44 652 | 6/1997 | Germany . |
| 0 786 923 | 7/1997 | Germany . |

*Primary Examiner*—Teresa Walberg
*Assistant Examiner*—Jeffrey Pwu
*Attorney, Agent, or Firm*—Klaus J. Bach

[57] ABSTRACT

In an arrangement for limiting the temperature of a glass-ceramic cooking zone including a cooking zone control unit which controls the electric power supply to the heating elements of the cooking zones by way of an impulse width control arrangement with a cycling relay, an additional module with a signal processing unit is provided with temperature sensors for sensing the cooking zone temperatures so as to provide temperature signals to an evaluation circuit which compares the temperature values with a maximum temperature value and keeps the cycling relay in an open position when the temperature values reach the maximum temperature to thereby interrupt the power supply to the heating elements and the signal processing unit and opens a main power supply if the temperature still rises after having reached the maximum value.

5 Claims, 1 Drawing Sheet

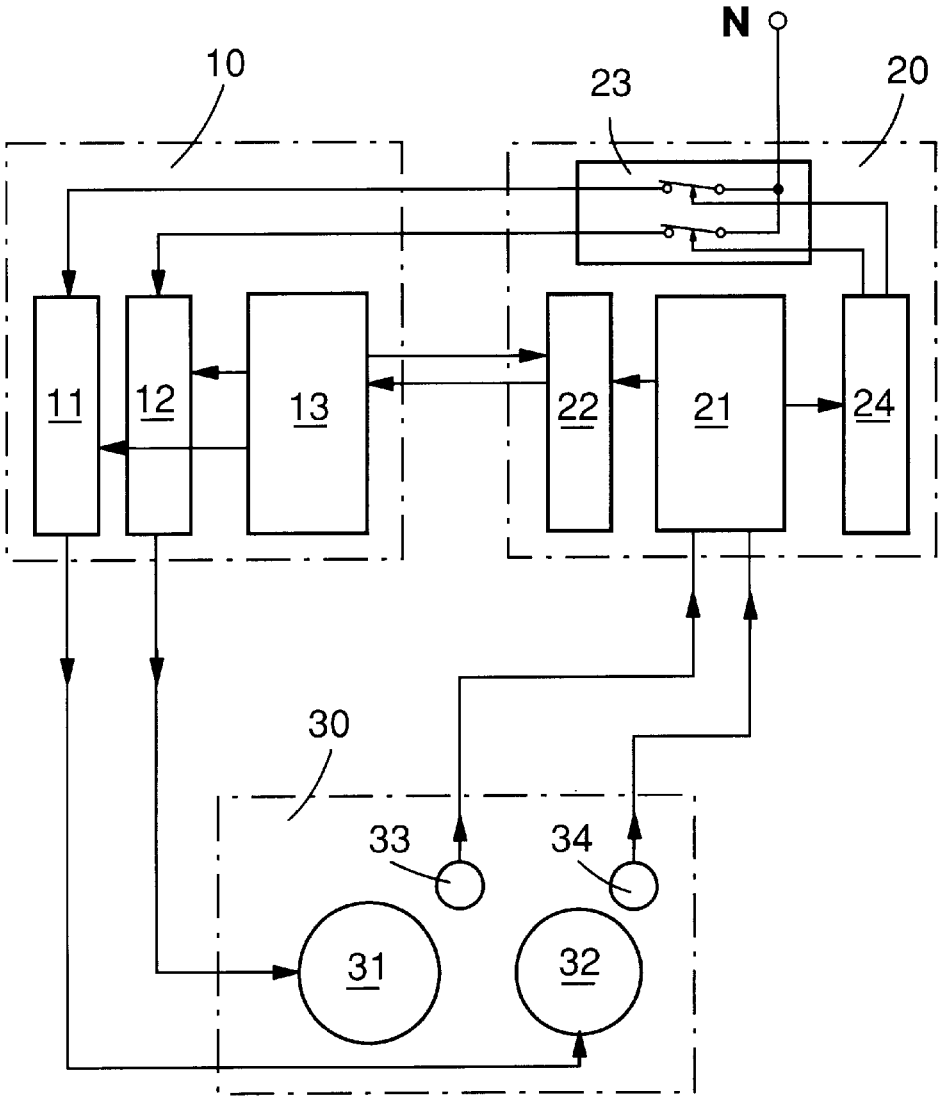
N
10
23
20
11
12
13
22
21
24
30
33
34
31
32

ARRANGEMENT FOR LIMITING THE TEMPERATURE OF A GLASS-CERAMIC COOKING ZONE

BACKGROUND OF THE INVENTION

The invention relates to an arrangement for limiting the temperature of a glass-ceramic cooking zone of ranges.

The glass-ceramics of cooking areas of ranges are subject to a temperature-dependent aging process, which negatively affects the structure of the glass-ceramic cooking surface. This results toward the end of the life in the breakage of the cooking area because of thermal distortions.

In order to ensure that glass-ceramic cooking areas have a life about 10 years under normal use the maximum temperature of the glass-ceramic in the area of the radiation heater should be limited to about 600° C.

Present control arrangements for the heater of glass-ceramic cooking areas include mechanical and electronic devices which however permit only a relatively inaccurate control of the heater temperature by controlling the impulse width of the heater current. The temperature of the glass-ceramic area is not sensed. Rather each heating element of the cooking area is provided with a simple mechanical temperature limiter, a so-called rod controllers which is intended to prevent heating of the cooking area above about 600° C. These rod controllers are mechanical temperature sensors. They consist of expansion rods, which assume the temperature of the heated area and which, as a result of their temperature dependent expansion, actuate a mechanical switch when reaching a certain maximum temperature. The switch is disposed in an electric power supply for the heating element. When the maximum temperature of the cooking zone is exceeded the electric power supply to the heating element is interrupted by the rod controller-operated switch. When the temperature of the cooking area has again reached an acceptable temperature and the rod controller has contracted the switch is again closed. This kind of temperature control is widely used and temperature limiting arrangements for glass-ceramic cooking areas are disclosed, for example, in the publications DE OS 25 15 905, DE OS 30 07 037, DE-OS 34 10 442, DE-OS 34 23 085, DE-OS 39 13 289 and DE-OS 39 31 763.

These temperature limiting arrangements however have a disadvantage in that they are quite inaccurate and have a large tolerance range. A major reason herefor is their design since there is a relatively large distance between the glass-ceramic plate and the rod controller. The rod controller therefore senses always a temperature, which differs from the actual temperature of the glass-ceramic cooking area. Consequently, the maximum temperature at which the rod controller interrupts the power supply to the heater must be selected to be relatively low in order to ensure that the 600° C. limit is not exceeded.

EP-0 786 923 A2 discloses a temperature limiting arrangement for a glass-ceramic cooking zone, wherein, instead of a mechanical temperature sensor in the form of a rod controller, an electronic temperature sensor is provided. The electronic temperature sensor senses the temperature of the glass-ceramic plate directly and operates a relay or a semi-conductor switching device which controls the power supply to the heater based on the signal provided by the electronic temperature sensor.

With this arrangement, the temperature of the cooking plate is directly sensed —in contrast to the earlier rod controller arrangements —so that the temperature is more accurately sensed and a more accurate temperature limit can be achieved. However, this arrangement is not satisfactory with respect to the safety requirements of the VDE (German association of Engineers), which requires two independent safety modules which can supervise each other to ensure that the cooking plate cannot exceed the maximum temperature.

The rod controllers do not encounter the problem in the way as it occurs with temperature limit arrangements on the basis of electronic temperature sensors in connection with an electronic control device. In such electronic arrangements the temperature sensor as well as the switching element may fail or the conductor providing the temperature signal from the temperature sensor may, for example, be interrupted. This can not happen with the purely mechanical expansion rod control arrangement which opens the switch contact directly when it is excessively heated. Failures are possible only in that the switch contact gets stuck in an open position or in that the contact arm breaks, which however results in an interruption of the power supply to the heating element and which consequently does not represent a safety risk.

It is the object of the present invention to provide a reliable and accurately operating temperature limiting arrangement for a glass-ceramic cooking zone, which also complies with the desired safety standards.

SUMMARY OF THE INVENTION

In an arrangement for limiting the temperature of a glass-ceramic cooking zone including a cooking zone control unit which controls the electric power supply to the heating elements of the cooking zones by way of an impulse width control arrangement with cycling relay, an additional module with a signal processing unit is provided with temperature sensors for sensing the cooking zone temperatures so as to provide temperature signals to an evaluation circuit which compares the temperature values with a maximum temperature value and keeps the cycling relay in an open position when the temperature values reach the maximum temperature to thereby interrupt the power supply to the heating elements and the signal processing unit and opens a main power supply if the temperature still rises after having reached the maximum value.

With the control arrangement according to the invention, the temperature is sensed by temperature sensors directly at the glass-ceramic cooking zone so that the actual temperature values are available to the control arrangement and the temperature increases as well as decreases can be determined accurately without delay. The temperature limiting function is provided by an evaluation of the sensor signal by way of the cooking zone control unit, that is, by an electronic switch, which controls the power supply to the respective cooking zone heater by controlling the impulse width of the current. In an additional module at the same time, the temperature is monitored on the basis of the sensor signals and also the likelihood of a failure is considered. If it is determined that a failure has occurred in the cooking zone control arrangement or if the temperature at any one cooking zone rises above the temperature limit, the additional module de-energizes a relay which controls the heating circuit supply to the cooking zones. The cooking zone control unit also monitors constantly the operation of the additional module and interrupt the heating current supply to the cooking zone if temperature signals fail to be transmitted from the additional module or the temperature signals transmitted therefrom seem to be unreasonable. As a result, there is a constant interactive control of the cooking zone control unit and the additional module so that the requirement for two independently operating safety systems which monitor each other is fulfilled and the required high measure of safety is ensured. Consequently, the power supply to the cooking zone is safely interrupted if a failure in one or the other of the cooking zone control unit and the additional module should occur or if a sensor or an electronic switching element would fail or if a conductor would be interrupted.

An embodiment of the invention will be described on the basis of the accompanying drawing.

DESCRIPTION OF A PREFERRED EMBODIMENT

A temperature limit control arrangement as shown in the figure comprises two electronic modules, that is, a cooking zone control unit 10 as it is known for example from DE 44 19 866 A1 and an additional module 20 for monitoring the presence of a pot and the temperature of the cooking zone. The additional module 20 gathers and processes information obtained from the sensors concerning the presence of pots on the cooking area 30 and the temperature of the glass ceramic cooking plate.

The cooking area 30 is shown in the figure to include only two cooking zones each with a heating element 31 and 32, respectively. Also only one temperature sensor 33 and 34 is shown for each cooking zone, although each cooking zone may be provided with several temperature sensors and also with at least one sensor for determining the presence of pots (not shown). The temperature sensors 33 and 34 are shown in the figure at the sides of the heating elements 31 and 32 respectively, for clarity reasons. This does not indicate their actual locations.

The cooking zone control unit 10, which is shown in the figure only in the form of a box may include a controller with a number of cooking zones on the cooking area for the activation and the temperature selection of the respective cooking zones. The respective cooking zones are activated by the respective sub-units. The figure shows only the control relay impulse width control arrangements 11 and respectively, 12 in the form of blocks which are disposed in the heater current supply lines to the respective cooking zone heating elements 31 and, respectively, 32.

The additional module 20 includes a micro-controller 21, which evaluates the sensor signals and which converts them for the determination of temperature values and, respectively, for the detection of the presence of pots, to status signals. This information is supplied by the additional module 20 to the cocking zone control unit 10 by way a communication interface 22.

The cocking zone control unit 10, which receives the information concerning the temperature of the glass-ceramic plate is able to act also as a temperature limiting device utilizing the control relay which is present in the cooking level control for each cooking zone. The control release (blocks 11 and 12), which is disposed in the power supply, one for each cooking zone heating element 31, 32, is actually provided to control the pulse width of the power supply current for the heating element of the respective cooking zone. The heating element can be disconnected from the power supply by holding the relay in an open position, when the maximum temperature is exceeded.

To achieve the temperature limiting function, the cooking zone control unit 10 includes a signal evaluation circuit 13, which is connected to the communication interface 22 of the additional module 20. The signal evaluation circuit 13 interrogates cyclically the temperature sensors 32, 33 for the temperatures of the cooking areas by way of the communication interface 22 and, the additional module 20 transmits the information to the cooking zone control unit 10 by way of the interface 22. In the signal evaluation unit 13 of the cooking zone control unit 10, the actual temperature of each cooking zone is constantly compared with the acceptable maximum value. If the maximum temperature is exceeded at any one cooking zone, the signal evaluation unit 13 addresses the respective control arrangement 11 or 12 such that the impulse width control associated with the respective cooking zone keeps the cycling relay open. As a result, power supply to the respective heating element 31 or 32 is interrupted. In this way, the cycling relay controls not only the impulse width but, under the control of the signal evaluation unit 13, also assumes the function of a temperature limiter for the respective cooking zone.

Further means however are necessary to provide the required safety: if a relay should get stuck, for example, in an open or closed position a cooking element may not be disconnected from the power supply unless the range is unplugged or otherwise disconnected from the power supply.

In order to solve this problem, the additional module 20 includes a second safety feature. It is activated when a temperature measured by the sensors 33, 34 increases further beyond the acceptable maximum temperature.

For this purpose, the additional module 20 includes a load member 23 having at least one main relay by which the power supply path for the heating elements 31, 32 of the cooking zones from the net N is established. A single relay may be provided for the whole cooking area, or one relay for each cooking zone or for a group of cooking zones may be provided. This at least one relay is accessible only to the additional module 20.

In order to attend to these safety disconnect functions, the micro-controller 21 compares the temperature measured with a threshold value which is somewhat higher than the maximum value. This comparison is performed independently of the comparison performed in the signal evaluation unit 13 of the cooking zone control unit 10 in which it is checked whether the cooking zone temperature is below the acceptable maximum temperature. It determines whether the temperature of the cooking zone increases further after reaching the maximum temperature.

If this is the case, it indicates that the temperature limiting function of the cooking zone control unit 10 is not properly operating. Consequently, if the temperature of one of the cooking zones increases above the maximum admissible temperature and reaches the predetermined threshold value, an initiation circuit 24 is activated. The initiation circuit is connected to the load member 23 and opens the main relay contained therein so that the power supply is interrupted already ahead of the impulse width control arrangement of the cooking zone control unit 10.

The switching off of the main relay can also be initiated by way of the initiation circuit 24 if the micro-controller 21, which also performs a reasonability check of the sensor values supplied to it by the sensors 33, 34, determines that there are errors in the measuring results such as a temperature jump within a seconds range, missing temperature signals etc., which indicate sensor failure or conductor problems, etc.

In this way, the additional module 20 monitors the proper functioning of the sensors and also the proper functioning of the cooking zone control unit 10 as far as the control units 10 temperature limiting functions are concerned.

Vice versa, the cooking zone control unit 10 monitors the operation of the additional module 20 by way of the evaluation unit 20. If it is determined, for example, in the cooking zone control unit 10 that the micro-controller 21 of the additional module 20 is not operating properly, the cooking zone control unit 10 blocks the control arrangements 11, 12 of all the heating elements 31, 32 and interrupts the power supply to the heating elements. Events, which are interpreted by the evaluation circuit 13 of the cooking zone control unit 10 as failure of the additional module 20 are for example the interruption of the communication between the two modules or the receipt of unreasonable information, for example temperature signals from a cooking zone not in use or rapid temperature jumps. The cooking zone control unit 10 then blocks the control relay for all the heating elements in their open positions since no temperature limiting functions can be established as no useable temperature information is available.

With the temperature limiting arrangement according to the invention, it is therefore, possible to eliminate the mechanical rod controllers in the heating element without negatively affecting the safety. The temperature limiting arrangement according to the invention fulfills all safety requirements. It accurately determines the temperature of the cooking zones directly at the glass-ceramic cooking areas by way of the two modules, that is, the cooking zone control unit and the additional module which monitor each others operation, thereby providing for high safety.

What is claimed is:

1. An arrangement for limiting the temperature of a glass-ceramic cooking zone having a heating element, a cooking zone control unit including a heating current impulse width control arrangement for controlling the supply of power to each heating element corresponding to a heating level setting, and temperature sensors arranged directly at said ceramic cooking zones, said arrangement comprising the following features:

a) said cooking zone control unit includes an additional module having a signal processing unit to which said temperature sensors are connected and which converts the signals of said temperature sensors to temperature signals;

b) said cooking zone control unit includes a signal evaluation circuit which receives the temperature signals generated by said signal processing unit of the additional module and compares the temperature signal of each temperature sensor with a maximum temperature value;

c) said signal evaluation circuit of said cooking zone control unit causes blocking in an open position of said impulse width controlling relay in the power supply line to said heating element of the respective cooking zone when said temperature signal of the respective cooking zone reaches said maximum temperature, d) said signal process unit of said additional module compares the sensed temperature values with a threshold value which is higher than said maximum temperature, and e) said arrangement includes a main relay disposed in the power supply line and said signal processing unit causes opening of said main relay when a temperature value sensed at any one cooking zone reaches said threshold value.

2. An arrangement according to claim 1, wherein said additional module includes a communication interface and said signal evaluation circuit of said cooking zone control unit cyclically receives said temperature sensor values from said signal processing unit via said communication interface.

3. An arrangement according to claim 2, wherein said evaluation circuit of said cooking zone control unit determines whether the temperature signals transmitted by the signal processing unit are reasonable and blocks the cycling relay in an open position if communication with the signal processing unit is interrupted or the signals supplied appear to be unreasonable so that power supply to said cooking zones is interrupted.

4. An arrangement according to claim 1, wherein said signal processing unit of said additional module includes an initiation circuit which opens said main relay when any of said temperature signals reaches said threshold value.

5. An arrangement according to claim 1, wherein the power supply for each of said heating elements or for a group of heating elements includes a main relay.

* * * * *